US008028609B2

(12) United States Patent
Katsuyama

(10) Patent No.: US 8,028,609 B2
(45) Date of Patent: Oct. 4, 2011

(54) WORK SHEET PROCESSING SYSTEM

(75) Inventor: Daisuke Katsuyama, Inuyama (JP)

(73) Assignee: Murata Machinery, Ltd., Kyoto-shi, Kyoto (JP)

( * ) Notice: Subject to any disclaimer, the term of this patent is extended or adjusted under 35 U.S.C. 154(b) by 834 days.

(21) Appl. No.: 12/107,220

(22) Filed: Apr. 22, 2008

(65) Prior Publication Data

US 2008/0264758 A1 Oct. 30, 2008

(30) Foreign Application Priority Data

Apr. 25, 2007 (JP) ..... 2007-115163

(51) Int. Cl.
*B23Q 7/00* (2006.01)
*B65G 37/00* (2006.01)

(52) U.S. Cl. ..... 83/78; 83/86; 83/167; 83/152; 198/346.2

(58) Field of Classification Search ..... 83/78, 151, 83/167, 92, 91, 92.1, 152, 86, 402; 271/197, 271/9.12, 9.13, 9.11; 414/798.7, 791.6, 796.2, 414/769.9, 751.1, 752.1, 753.1, 783; 198/346.2
See application file for complete search history.

(56) References Cited

U.S. PATENT DOCUMENTS 4,515,050 A * 5/1985 Haenni et al. ..... 83/76.6
4,955,854 A * 9/1990 Roth ..... 225/103
6,006,638 A * 12/1999 Eltringham ..... 83/86

FOREIGN PATENT DOCUMENTS

JP 05-306003 A 11/1993
JP 2000-117374 A 4/2000
JP 3126755 B2 11/2000
JP 3400043 B2 2/2003

* cited by examiner

*Primary Examiner* — Ghassem Alie
(74) *Attorney, Agent, or Firm* — Westerman, Hattori, Daniels & Adrian, LLP

(57) ABSTRACT

A work sheet processing system enables the effective utilization, of a redundant work sheet corresponding to a material work sheet from which product work sheets have been cut. The work sheet processing system includes a work sheet processing machine that performs a processing operation of cutting a product word sheet from a material work sheet, a redundant work sheet stocker that stores a redundant work sheet that is a remaining part of the material work sheet from which the product work sheet has been cut by the work sheet processing machine, and carry-in and carry-out means for carrying out the redundant work sheet stored in the redundant work sheet stocker into the original work sheet processing machine or another work sheet processing machine.

2 Claims, 7 Drawing Sheets

WORK SHEET PROCESSING SYSTEM

FIELD OF THE INVENTION

The present invention relates to a work sheet processing system that enables the effective utilization of redundant work sheets resulting from a processing operation of a work sheet processing machine.

BACKGROUND OF THE INVENTION

Work sheet processing machines such as punch presses perform not only processing operations such as hole making and shape formation but also a processing operation of cutting product work sheets from a material work sheet by punching or the like. With importance attached to the processing efficiency of the work sheet processing machine, material work sheets of the same size are often used in spite of the different sizes or shapes of product work sheets that are to be cut from the material work sheet. Thus, depending on the type of the product work sheets, after the product work sheets are cut from the material work sheet, a redundant work sheet may remain which can still be processed into product work sheets. Such a sheet is conventionally disposed of as a waste material instead of being effectively utilized.

On the other hand, product work sheets are carried out from the work sheet processing machine by a work sheet conveying device (for example, the Unexamined Japanese Patent Application Publication (Tokkai) No. 2000-117374). The product work sheets are then stored in a work sheet cabinet (for example, the Unexamined Japanese Patent Application Publication (Tokkai-Hei) No. 5-306003) or loaded on a vehicle and transported to the next step. The redundant work sheet is not conveyed by the work sheet conveying device or stored in the work sheet cabinet.

As described above, in the prior art, the redundant work sheet is disposed of instead of being effectively utilized, resulting in the wasteful use of the material. Although the waste can be eliminated by cutting plural types of product work sheets from one material work sheet, this is difficult for the following reason. That is, in order to avoid increasing an intermediate stock and complicating a sorting operation, a processing schedule for the work sheet processing machine is basically specified such that the product work sheets are processed in the order in which the product work sheets need to be used during the subsequent steps. Thus, product work sheets of the same type or product work sheets to be used during the same step are necessarily processed consecutively, unavoidably generating redundant work sheets.

It is thus possible to temporarily store a redundant work sheet generated by the work sheet processing machine, in a different place and to bring the redundant work sheet back to the work sheet processing machine for use where the redundant work sheet can be utilized for the process. To achieve this, it is necessary to provide a device transporting the redundant work sheet and a facility in which the redundant work sheet is stored. However, the conventional technique does not provide such a device or a facility. It is convenient to utilize the work sheet conveying device and work sheet cabinet for product work sheets to convey and store redundant work sheets. However, this may affect the conveyance and storage of the product work sheets or result in confusion owing to the mixture of the product work sheets and redundant work sheets.

An object of the present invention is to provide a work sheet processing system that enable the effective utilization, without adverse effects on the operation of a work sheet processing machine or other peripheral devices, of a redundant work sheet corresponding to a material work sheet from which product work sheets have been cut, a part of the redundant work sheet being still capable of being processed into other product work sheets. Another object of the present invention is to allow the redundant work sheet to be efficiently carried out from and into the work sheet processing machine. Yet another object of the present invention is to provide a means for carrying in and out the redundant work sheet, the means having a simple configuration and allowing redundant work sheet to be reliably carried in and out.

SUMMARY OF THE INVENTION

A work sheet processing system according to the present invention comprises a work sheet processing machine that performs a processing operation of cutting a product word sheet from a material work sheet, a redundant work sheet stocker that stores a redundant work sheet that is a remaining part of the material work sheet from which the product work sheet has been cut by the work sheet processing machine, and a carry-in and carry-out means for carrying out the redundant work sheet from the work sheet processing machine to the redundant work sheet stocker and carrying the redundant work sheet stored in the redundant work sheet stocker into the original work sheet processing machine or another work sheet processing machine.

This configuration allows the redundant work sheet generated by the work sheet processing machine to be carried out by the carry-in and carry-out means, and stored in the redundant work sheet stocker. Furthermore, the redundant work sheet stored in the redundant work sheet stocker can be carried into the original work sheet processing machine or a different work sheet processing machine by the carry-in and carry-out means as required. The redundant work sheet can thus be effectively utilized. The redundant work sheet stocker and the carry-in and carry-out means are used exclusively for redundant sheets and do not affect the operation of the work sheet processing machine or other peripheral devices.

A carry-in destination into which the carry-in and carry-out means carries the redundant work sheet may be the original work sheet processing machine. In this case, the carry-in and carry-out means may comprise a work sheet holder that holds the redundant work sheet, and the work sheet holder may carry in and out the redundant work sheet by moving while holding the redundant work sheet.

Where the carry-in destination into which the redundant work sheet is carried is the original work sheet processing machine, a carry-out path for redundant work sheets can also be used as a carry-in path for redundant work sheets, or vice versa. In this case, where the carry-in and carry-out means is configured to carry in and out the redundant work sheet by moving while holding the redundant work sheet, a carry-in operation and a carry-out operation can be smoothly switched. The redundant work sheet can thus be efficiently carried out from and into the work sheet processing machine.

Furthermore, the redundant work sheet stocker may be located on a side of and adjacent to the work sheet processing machine. The redundant work sheet stocker can freely move the redundant work sheet in a predetermined carry-in and carry-out direction corresponding to a direction in which the work sheet processing machine and the redundant work sheet stocker are arranged. The work sheet processing machine may have a work sheet positioning mechanism that moves a work sheet to a processing head of the work sheet processing machine which performs the processing operation. The work sheet positioning mechanism can move the work sheet in the carry-in and carry-out direction.

In this configuration, the redundant work sheet stocker may be located on the side of and adjacent to the work sheet processing machine. The carry-in and carry-out means can thus be compactly configured. Since the redundant work sheet stocker can freely move the redundant work sheet in the predetermined carry-in and carry-out direction corresponding to the direction in which the work sheet processing machine and the redundant work sheet stocker are arranged, the redundant work sheet can be reliably carried out from and into the work sheet processing machine. Furthermore, the work sheet positioning mechanism of the work sheet processing machine can move the work sheet in the carry-in and carry-out direction and can thus assist the carry-in and carry-out means. The carry-in and carry-out means can thus be more compactly configured.

The work sheet processing system according to the present invention comprises the work sheet processing machine that performs the processing operation of cutting the product word sheet from the material work sheet, the redundant work sheet stocker that stores the redundant work sheet that is the remaining part of the material work sheet from which the product work sheet has been cut by the work sheet processing machine, and the carry-in and carry-out means for carrying out the redundant work sheet from the work sheet processing machine to the redundant work sheet stocker and carrying the redundant work sheet stored in the redundant work sheet stocker into the original work sheet processing machine or another work sheet processing machine. This allows the effective utilization, without adverse effects on the operation of the work sheet processing machine or other peripheral devices, of the redundant work sheet corresponding to the material work sheet from which the product work sheet has been cut, a part of the redundant work sheet being still capable of being processed into other product work sheets.

Where the carry-in destination into which the carry-in and carry-out means carries the redundant work sheet is the original work sheet processing machine, and the carry-in and carry-out means comprises the work sheet holder which holds the redundant work sheet and which carries in and out the redundant work sheet by moving while holding the redundant work sheet, the redundant work sheet can be efficiently carried out from and into the work sheet processing machine.

Where the redundant work sheet stocker is located on the side of and adjacent to the work sheet processing machine and can freely move the redundant work sheet in the predetermined carry-in and carry-out direction corresponding to the direction in which the work sheet processing machine and the redundant work sheet stocker are arranged, and the work sheet processing machine has the work sheet positioning mechanism which moves the work sheet to the processing head of the work sheet processing machine which performs the processing operation, and the work sheet positioning mechanism can move the work sheet in the carry-in and carry-out direction, then the means for carrying in and out the redundant work sheet has a simple configuration and can reliably carry in and out the redundant work sheet.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
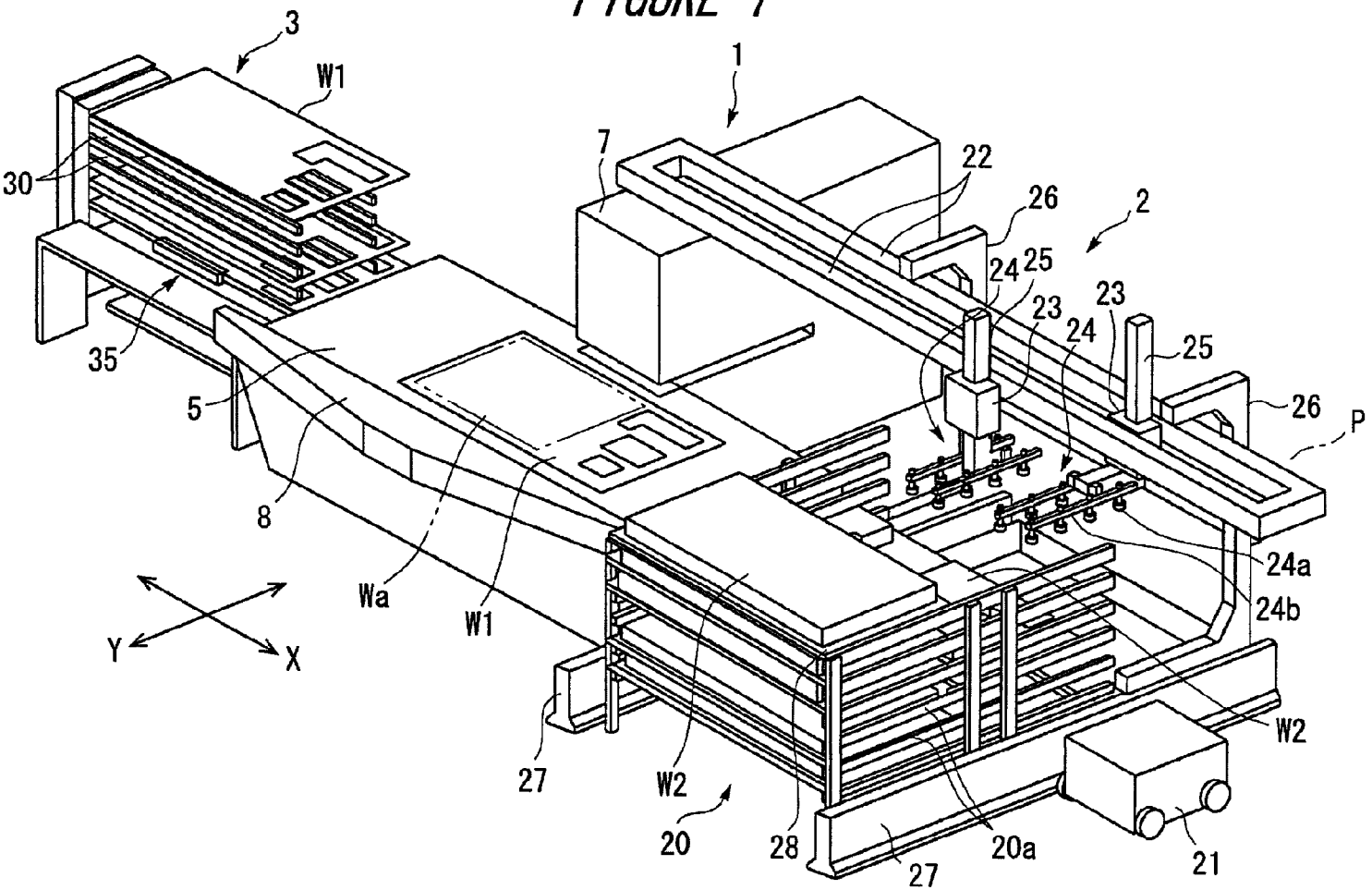
FIG. 1 is a perspective view of a work sheet processing system according to an embodiment of the present invention.

Embodiments of the present invention will be described with reference to FIG. 1 to FIG. 7. As shown in FIG. 1, a work sheet processing system according to the present invention comprises a work sheet processing machine 1, a work sheet conveying device 2 provided on one lateral side of the work sheet processing machine 1 (in an X direction), and a redundant work sheet stocker 3 provided opposite the work sheet conveying device 2 across the work sheet processing machine 1 and adjacent to the work sheet processing machine 1.

The work sheet processing machine 1 comprises a function of cutting product work sheets W2 (FIG. 1) from a material work sheet W (FIG. 2) on a table 5 by means of punching or the like. In this example, the work sheet processing machine 1 is a punch press comprising a processing head 7 that elevates and lowers a punch tool (not shown in the drawings) with respect to a die tool (not shown in the drawings), and a work sheet positioning mechanism 8 that moves the material work sheet W on the table 5 forward and backward (Y direction), and rightward and leftward (X direction) with respect to the processing head 7 for positioning.

Figure 2:
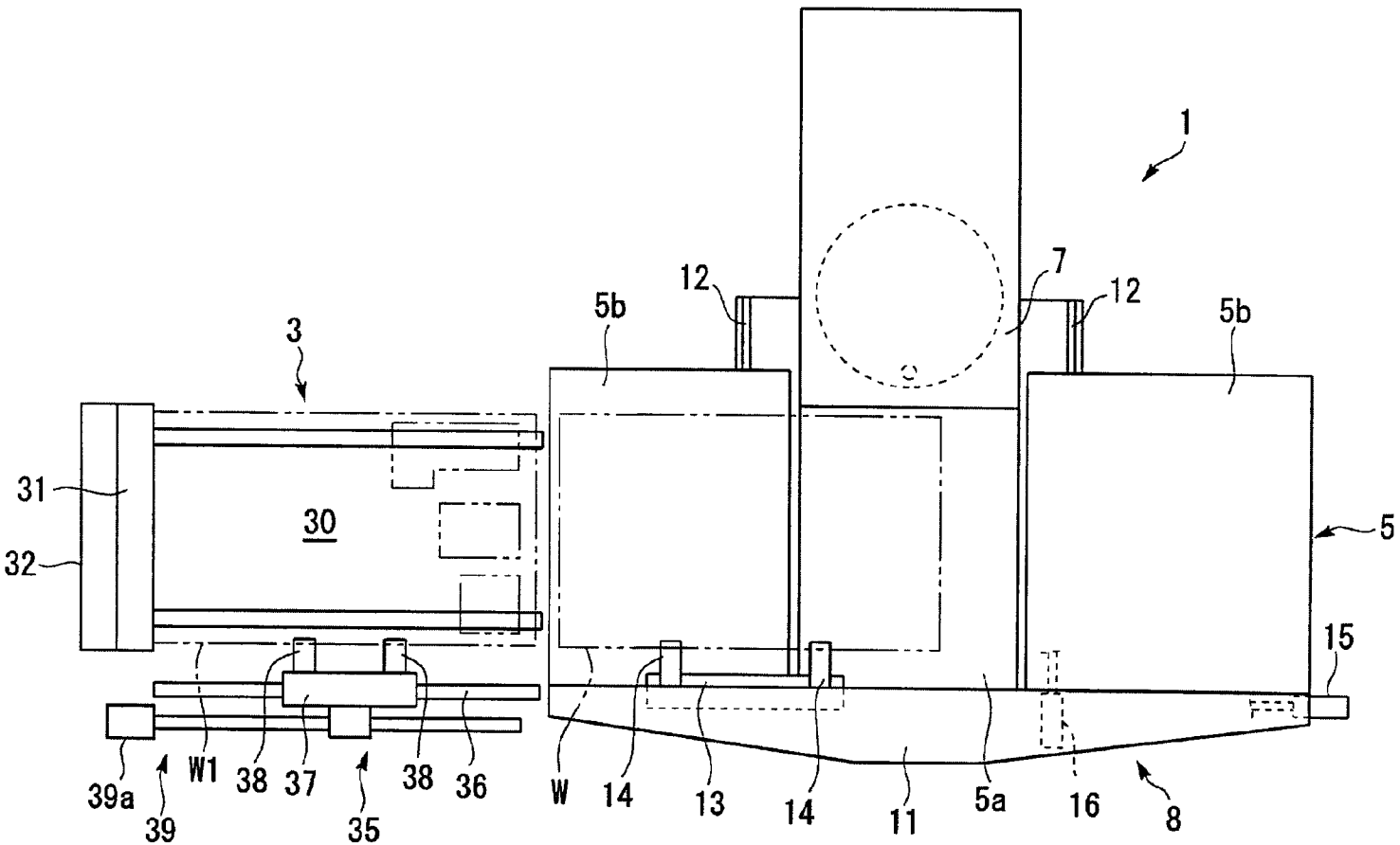
FIG. 2 is a plan view of a work sheet processing machine and a redundant work sheet stocker in the work sheet processing system.

The work sheet positioning mechanism 8 will be described. As shown in FIG. 2, the table 5 is composed of a fixed table 5*a* and a movable table 5*b*. The movable table 5*b* moves forward and backward on a rail 12 together with a carriage 11. A cross slide 13 is installed on the carriage 11 so as to be movable rightward and leftward. A plurality of work holders 14 are attached to the cross slide 13. The work holders 14 hold the work sheet W by sandwiching a front edge of the work sheet W between the work holders 14. The carriage 11 and the cross slide 13 are driven by servo motors 15, 16 for respective shafts via motion converting mechanisms such as ball screws.

As shown in FIG. 1, the work sheet conveying device 2 carries the material work sheet W into the work sheet processing machine 1, carries out the material work sheet W processed by the work sheet processing machine 1, or performs both the carry-in and carry-out operations. The work sheet carry-out device 2 comprises two tracks 22 installed parallel to each other between the work sheet processing machine 1 and a carry-in and carry-out position P, and facing in a lateral direction, and traveling members 23 that are independently travelable along the tracks 22. Each of the traveling members 23 has a work sheet sucker 24. The carry-in and carry-out position P includes a position where the work sheet stocker 20 is installed and a position where a work sheet transporting vehicle 21 is stopped.

The traveling members 23 are provided on the tracks 22 so as to be travelable along the tracks 22 via guide members (not shown in the drawings). The traveling members 23 are self-propelled by traveling driving sources such as servo motors. The guide members are, for example, linear roll bearings or guide rollers.

The work sheet sucker 24 uses, for example, suction pads 24*a* to suck and hold the work sheet. In the present embodiment, the plurality of suction pads 24*a* are attached to each of two pad support frames 24*b* extending in a front-back direction. The work sheet sucker 24 is attached to a moving up-down member 25 fitted into the traveling member 23 so as to be movable in a vertical direction. The moving up-down member 25 is moved up and down by an elevating and lowering driving source (not shown in the drawings) to elevate and lower the work sheet holder 24.

The two tracks 22 are integrally coupled together at the opposite ends thereof and supported by a lateral pair of forward-backward moving frames 26. Each of the laterally paired forward-backward moving frames 26 is movable along a forward-backward moving rail 27 and can be moved forward and backward by a forward-backward moving driving source (not shown in the drawings). The forward-backward moving driving source is composed of, for example, a servo motor and a converting mechanism such as a ball screw which converts rotation of the servo motor into linear motion.

The work sheet stocker 20 is a device in which the product work sheets W2 are placed on palettes 28 in a stack for storage. The work sheet stocker 20 has a shelf 20*a* with multiple stages on which the plates 28 are placed. The work sheet stocker 20 is configured such that the palette 28 on any stage of the shelf 20*a* can be advanced and retracted between a front storage position and a loading and unloading position located behind the storage position. The work sheet transporting vehicle 21 is a vehicle on which the product work sheets W2 are loaded in a stack and transported to the next step.

Figure 3:
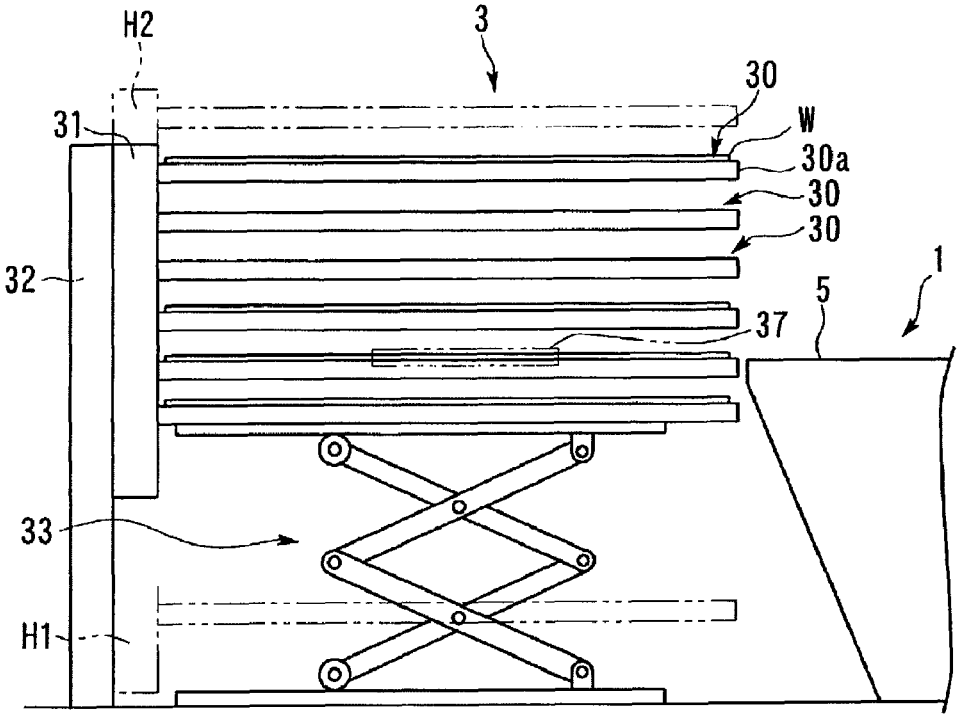
FIG. 3 is a front view of the redundant work sheet stocker.
Figure 4:
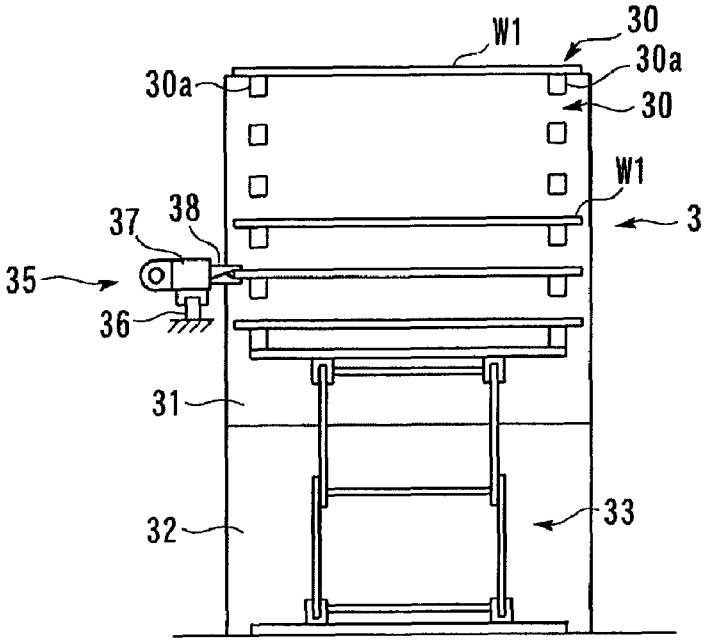
FIG. 4 is a side view of the redundant work sheet stocker.

The redundant work sheet stocker 3 is a device in which redundant work sheets W1 (FIG. 1) generated by the work sheet processing machine 1 are stored. The term "redundant work sheet" W1 as used herein refers to a work sheet corresponding to the material work sheet W from which the product work sheets W2 have been cut, a part Wa of the redundant work sheet being still capable of being processed into other product work sheets. As shown in FIG. 2 to FIG. 4, the redundant work sheet stocker 3 has a housing portion 30 with a plurality of stages on which the redundant work sheets W1 are housed. The housing portion 30 is composed of a front-back pair of work sheet supports 30*a*. The redundant work sheet W1 is supported from below by both work sheet supports 30*a*.

Each of the work sheet supports 30*a* in the housing portion 30 is fixed to an elevating and lowering member 31 at one end thereof. The elevating and lowering member 31 can be elevated and lowered along an elevating and lowering guide 32. An elevating and lowering mechanism 33 is provided under the housing portion 30 to elevate and lower each stage of the housing portion 30. In the present embodiment, the elevating and lowering mechanism 33 is based on a pantograph, and integrally elevates and lowers each stage of the housing portion 30 by using an elevating and lowering driving source (not shown in the drawings) to expand and contract the pantograph. The range of the elevation and lowering is between a lower limit position H1 where the uppermost stage of the housing portion 30 is located at the same height as that of the table 5 surface of the work sheet processing machine 1 and an upper limit position H2 where the lowermost stage of the housing portion 30 is located at the same height as that of the table 5 surface of the work sheet processing machine 1.

Furthermore, the redundant work sheet stocker 3 has carry-in and carry-out means 35 for the redundant work sheet W1. The carry-in and carry-out means 35 has guide rails 36 installed in front of the housing portion 30 and extending in the lateral direction. A work sheet holder 37 is movable along the guide rail 36. The work sheet holder 37 has work holders 38 that hold the redundant work sheet W1 positioned in the housing portion 30 at the same height as that of the table 5 surface of the work sheet processing machine 1, by sandwiching the front edge of the redundant work sheet W1 between the work holders 38. As moving means 39 for moving the work sheet holder 37 along the guide rail 36, for example, a configuration can be adopted which transmits the driving force of a servo motor 39*a* via a motion converting mechanism such as a ball screw. The work sheet holder 37 of the carry-in and carry-out means 35 grips the redundant member W1 positioned in the at the same height as that of the table 5 surface and moves toward the work sheet processing machine 1. The work sheet holder 37 draws out the redundant work sheet W1 from the housing portion 30 and carries the redundant work sheet W1 into the work sheet processing machine 1. The work sheet holder 37 further grips the redundant work sheet W1 on the work sheet processing machine 1 and moves toward the redundant work sheet stocker 3. The work sheet holder 37 thus carries out the redundant work sheet W1 to the redundant work sheet stocker 3. The direction in which the redundant work sheet W1 is carried in and out is the same as the direction in which the work sheet processing machine 1 and the redundant work sheet stocker 3 are arranged.

The work sheet positioning mechanism 8 of the work sheet processing machine 1 can move the work sheet W on the table 5 forward and backward (Y direction), and rightward and leftward (X direction) as described above. This rightward and leftward movement is utilized to assist in carrying out the redundant work sheet W1 located on the work sheet processing machine 1, to the redundant work sheet stocker 3 and in carrying the redundant work sheet W1 stored in the redundant work sheet stocker 3, into the work sheet processing machine 1.

Figure 5:
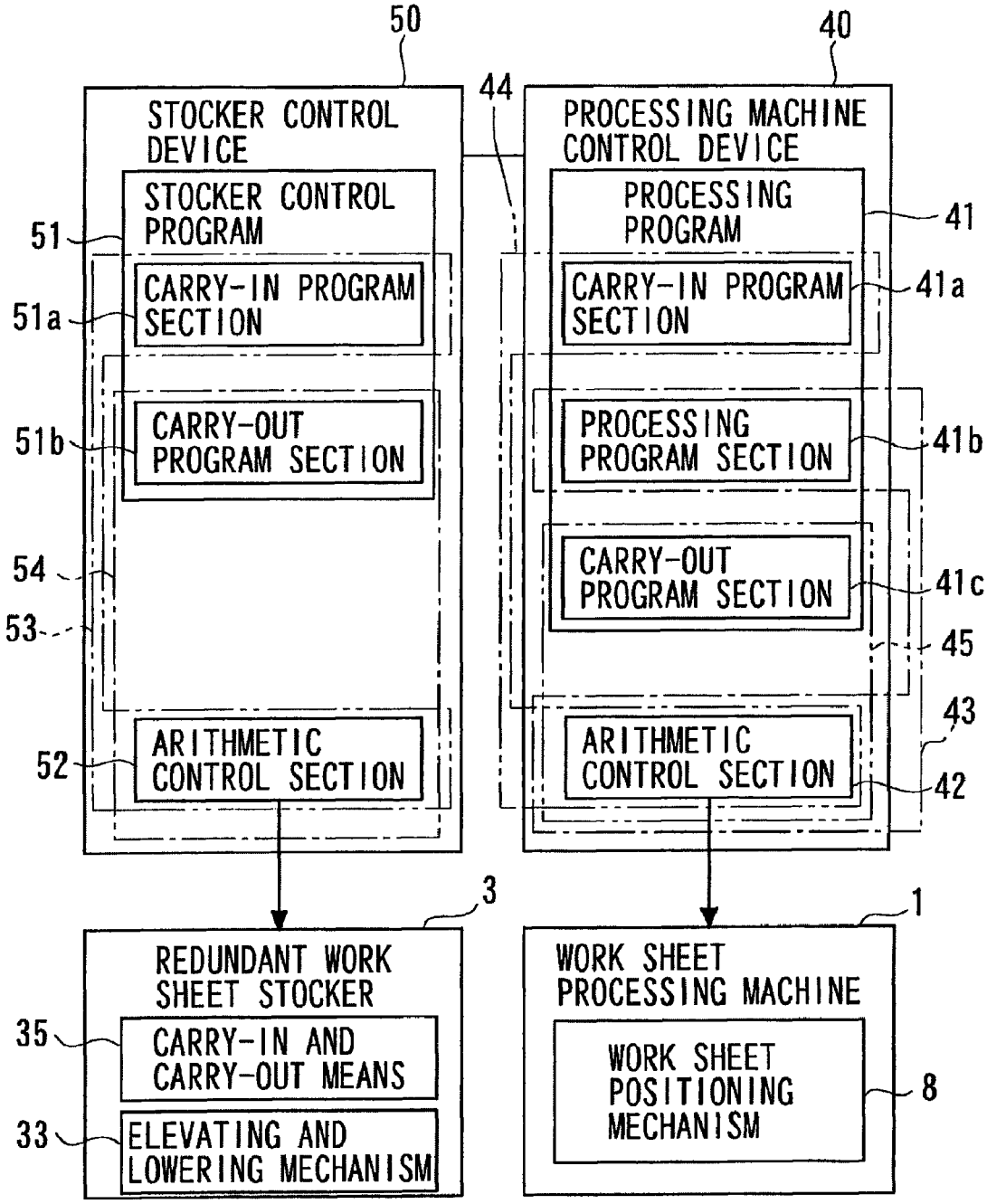
FIG. 5 is a block diagram showing the conceptual configuration of a control system for the operation of the work sheet processing machine and redundant work sheet stocker in the work sheet processing system.

With reference to FIG. 5, a description will be given of a control system for the operation of the work sheet processing machine 1 and the redundant work sheet stocker 3 in the work sheet processing system. The control system is composed of a processing machine control device 40 that controls each driving portion of the work sheet processing machine 1 and a stocker control device 50 that controls each driving portion of the redundant work sheet stocker 3. The processing machine control device 40 and the stocker control device 50 exchange information with each other. Each of the control devices 40, 50 is composed of a computerized numerical control device and a programmable controller.

The processing machine control device 40 comprises a processing program 41 and an arithmetic control section 42 that executes the processing program 41. The processing program 41 is composed of a carry-in program section 41*a*, a processing program section 41*b*, and a carry-out program section 41*c*. The carry-in program section 41*a* is a program that drives the work sheet positioning mechanism 8 to carry in the redundant work sheet W1 from the redundant work sheet stocker 3. The processing program section 41*b* is a program that drives the driving portion of the processing head 7 and the work sheet positioning mechanism 8 so as to perform a predetermined processing operation on the work sheet W on the table 5. The carry-out program section 41*c* is a program that drives the work sheet positioning mechanism 8 to carry the redundant work sheet W1 to the redundant work sheet stocker 3. The arithmetic control section 42 includes a central processing unit, a memory, and the like, as well as a programmable controller. The processing program section 41*b* and the arithmetic control section 42 constitute a processing control means 43 for allowing the work sheet processing machine 1 to cut the product work sheet W2 from the material work sheet W. The carry-in program section 41*a* and the arithmetic control section 42 constitute a carry-in assistance control means 44 for allowing the work sheet positioning mechanism 8 to assist in carrying the redundant work sheet W1 into the work sheet processing machine 1. Furthermore, the carry-out program section 41*c* and the arithmetic control section 42 constitute a carry-out assistance control means 45 for allowing the work sheet positioning mechanism 8 to assist in carrying out the redundant work sheet W1 from the work sheet processing machine 1.

The stocker control device 50 comprises a stocker control program 51 and an arithmetic control section 52 that executes the stocker control program 51. The stocker control program 51 is composed of a carry-in program section 51*a* and a carry-out program section 51*b*. The carry-in program section 51*a* is a program that allows the elevating and lowering mechanism 33 and the carry-in and carry-out means 35 to be driven in carrying the redundant work sheet W1 stored in the redundant work sheet stocker 3, into the work sheet processing machine 1. The carry-out program section 51*b* is a program that allows the elevating and lowering mechanism 33 and the carry-in and carry-out means 35 to be driven in carrying out the redundant work sheet W1 from the work sheet processing machine 1 to the redundant work sheet stocker 3. The arithmetic control section 52 includes a central processing unit, a memory, and the like, as well as a programmable controller. The carry-in program section 51*a* and the arithmetic control section 52 constitute a carry-in control means 53 for allowing the carry-in and carry-out means 35 to carry the redundant work sheet W1 stored in the redundant work sheet stocker 3, into the work sheet processing machine 1. Furthermore, the carry-out program section 51*b* and the arithmetic control section 52 constitute a carry-out control means 54 for allowing the carry-in and carry-out means 35 to carry out the redundant work sheet W1 located on the work sheet processing machine 1, to the redundant work sheet stocker 3.

Now, the control performed by the control system will be specifically described. Under the control of the processing control means 43, a processing operation of cutting the product work sheet W2 from the material work sheet W is performed. The processing control means 43 determines whether or not the processed work sheet corresponds to a usable redundant work sheet. Where the processed work sheet does not correspond to a usable redundant work sheet, the processing control means 43 allows the work sheet to be disposed of as a waste material. Where the processed work sheet corresponds to a usable redundant work sheet (FIG. 1), then under the control of the carry-out control means 54 and the carry-out assistance control means 45, the work sheet is carried out to the redundant work sheet stocker 3 as a redundant work sheet W1. Whether or not the processed work sheet corresponds to a usable redundant work sheet may be determined automatically by the program used for the processing or may be determined by an operator.

FIG. 6 shows an operation of carrying out the redundant work sheet W1.

Figure 6A:
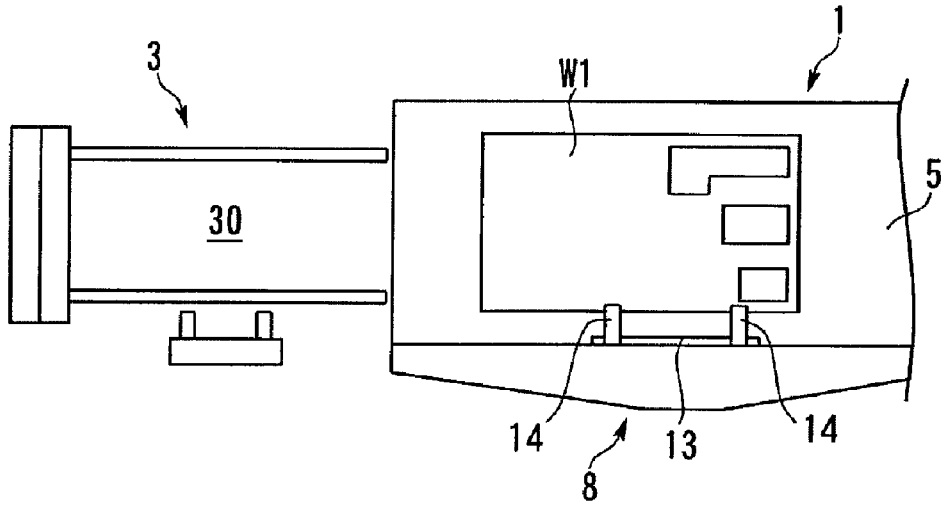
FIG. 6 is a diagram illustrating an operation of carrying out a redundant work sheet.
Figure 6B:
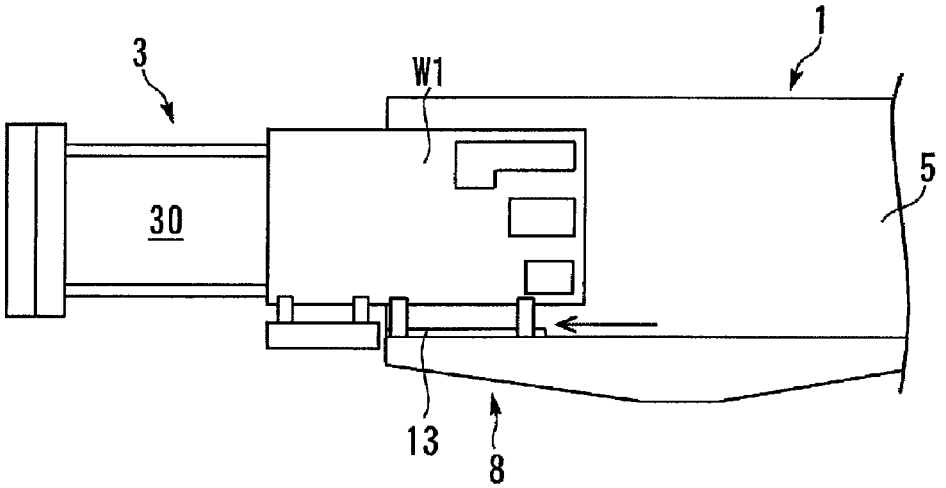
Figure 6C:
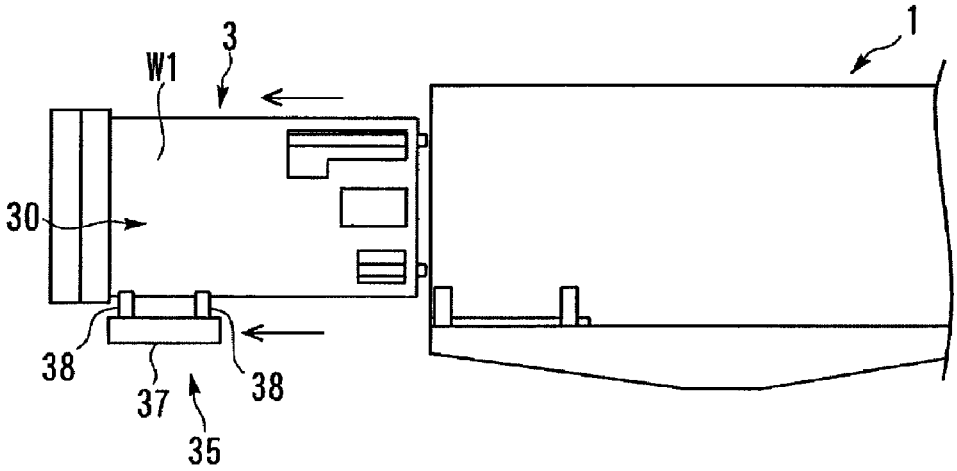

FIG. 6A shows that the processing operation has been completed. The redundant work sheet W1 is held at a processing position on the work sheet processing machine 1 by the work holder 14 of the cross slide 13. In this condition, the processing machine control device 40 gives an output instruction to the work sheet positioning mechanism 8 to cause the work sheet positioning mechanism 8 to move the cross slide 13 leftward (X direction) to insert a left end of the redundant work sheet W1 into the housing portion 30 of the redundant work sheet stocker 3 as shown in FIG. 6B. Then, the stocker control device 50 gives an output instruction to the carry-in and carry-out means 35 to cause the carry-in and carry-out means 35 to use the work holder 38 of the work sheet holder 37 to hold the inserted part of the redundant work sheet W1 and to move the work sheet holder 37 holding the redundant work sheet W1 leftward to draw the redundant work sheet W1 toward the interior of the housing portion 30 as shown in FIG. 6C. Thus, the carry-out of the redundant work sheet W1 is completed. Since the direction in which the redundant material W1 is carried out by the carry-in and carry-out means 35 is the same as the direction in which the work sheet processing machine 1 and the redundant work sheet stocker 3 are arranged, the carry-out operation can be smoothly performed.

Furthermore, where the processing operation of cutting the product work sheet W2 is performed, if the redundant work sheet W1 stored in the redundant work sheet stocker 3 is usable, then under the control of the carry-in control means 53 and the carry-in assistance control means 44, the redundant work sheet W1 is carried from the redundant work sheet stocker 3 into the work sheet processing machine 1. Whether or not the redundant work sheet W1 is usable may be determined automatically on the basis of information on the redundant work sheet W1 and program information used for the processing or may be determined by the operator.

Figure 7A:
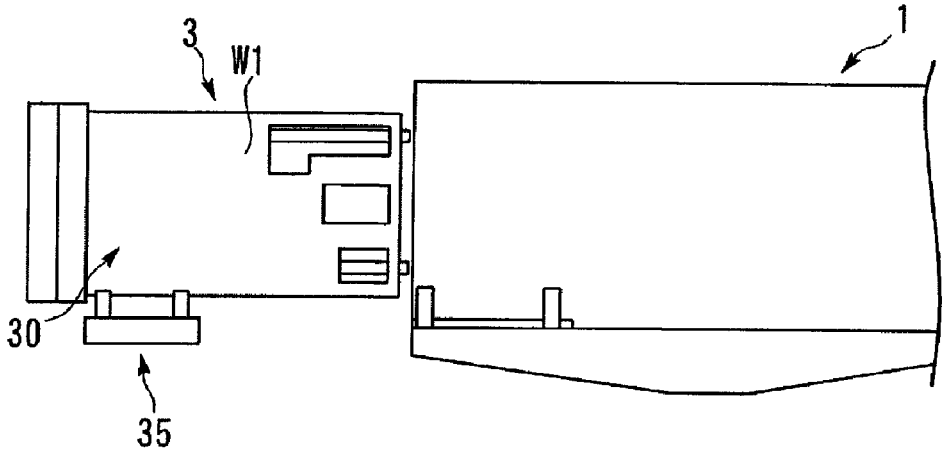
FIG. 7 is a diagram illustrating an operation of carrying in the redundant work sheet.
Figure 7B:
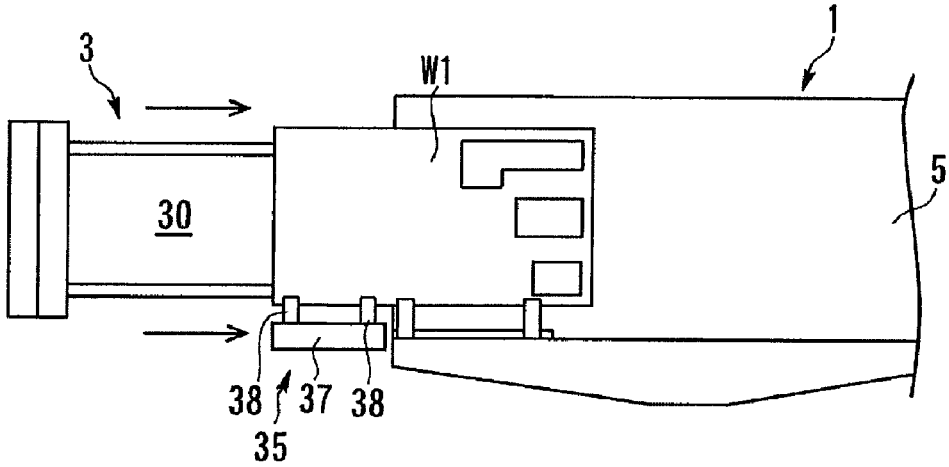
Figure 7C:
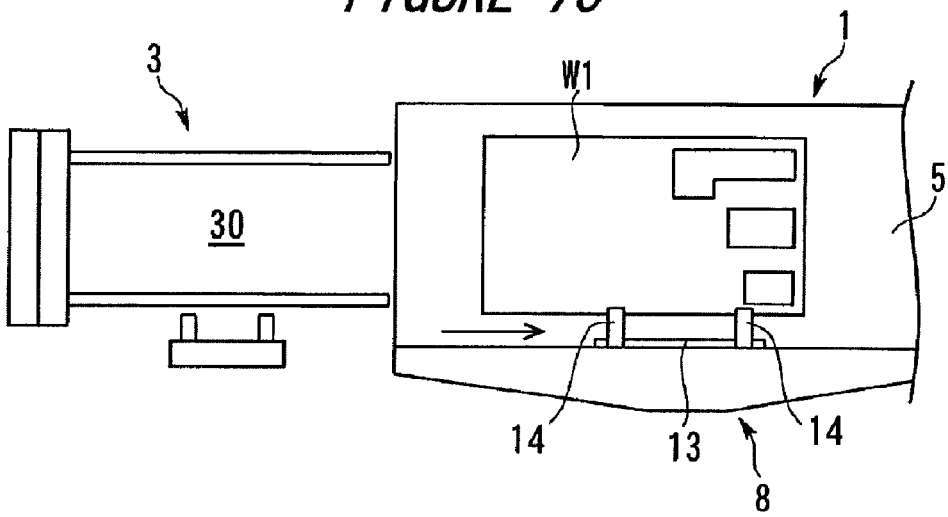

FIG. 7 shows an operation of carrying in the redundant work sheet W1. FIG. 7A shows how the redundant work sheet W1 is stored in the housing portion 30 of the redundant work sheet stocker 3. In this condition, the stocker control device 50 gives an output instruction to the carry-in and carry-out means 35 to cause the carry-in and carry-out means 35 to use the work holder 38 of the work sheet holder 37 to hold the redundant work sheet W1 and to move the work sheet holder 37 holding the redundant work sheet W1 rightward to carry the redundant work sheet W1 into the work sheet processing machine 1 as shown in FIG. 7B. Thus, most of the redundant work sheet W1 is positioned on the table 5 in the work sheet processing machine 1. Then, the processing control device 40 gives an output instruction to the work sheet positioning mechanism 8 to cause the work sheet positioning mechanism 8 to use the work holder 14 of the cross slide 13 to hold the redundant work sheet W1 and to move the cross slide 13 holding the redundant work sheet W1 rightward to convey the redundant work sheet W1 to the processing position on the work sheet processing machine 1 as shown in FIG. 7C. Thus, the carry-in of the redundant work sheet W1 is completed. As is the case with the carry-out operation, since the direction in which the redundant material W1 is carried in by the carry-in and carry-out means 35 is the same as the direction in which the work sheet processing machine 1 and the redundant work sheet stocker 3 are arranged, the carry-in operation can be smoothly performed.

For the operations of carrying in and out the redundant work sheet W1, the stocker control device 50 issues an output instruction to the elevating and lowering mechanism 33 to control the height of the housing portion 30 so that for the carry-out operation, an empty stage of the housing portion 30 is positioned at the height of the table 5 in the work sheet processing machine 1 and so that for the carry-in operation, the stage of the housing portion 30 on which the redundant work sheet W1 to be carried in is stored is located at the height of the table 5.

This work sheet processing system can store the redundant work sheet W1 generated by the work sheet processing machine 1, in the redundant work sheet stocker 3 and carry the stored redundant work sheet 1 into the work sheet processing machine 1 as required. The redundant work sheet W1 can thus be effectively utilized. Since the redundant work sheet stocker 3 and the carry-in and carry-out means 35 are exclusively used for the redundant work sheets W1, the operation of the work sheet processing machine 1 and other peripheral devices, for example, the work sheet conveying device 2, is prevented from being affected. The work sheet processing system operates efficiently because the work sheet processing machine 1 is control led by the processing control means 43, the carry-in assistance control means 44, and the carry-out assistance control means 45, and the carry-in and carry-out means 35 is controlled by the carry-in control means 53, and the carry-out control means 54.

The redundant work sheet stacker 3 is located on the side of and adjacent to the work sheet processing machine 1. The carry-in and carry-out means 35 can thus be compactly configured. The carry-in and carry-out means 35 carries in and out the redundant work sheet W1 in the direction in which the work sheet processing machine 1 and the redundant work sheet stocker 3 are arranged. The redundant work sheet W1 can thus be reliably carried into and out from the work sheet processing machine 1. Furthermore, the work sheet positioning mechanism 8 of the work sheet processing machine 1 can move work sheets in the direction in which the carry-in and carry-out means 35 moves the redundant work sheet W1 in the carry-in and carry-out direction. Consequently, the work sheet positioning mechanism 8 can assist the carry-in and carry-out means 35. The carry-in and carry-out means 35 can thus be more compactly configured.

Figure 8:
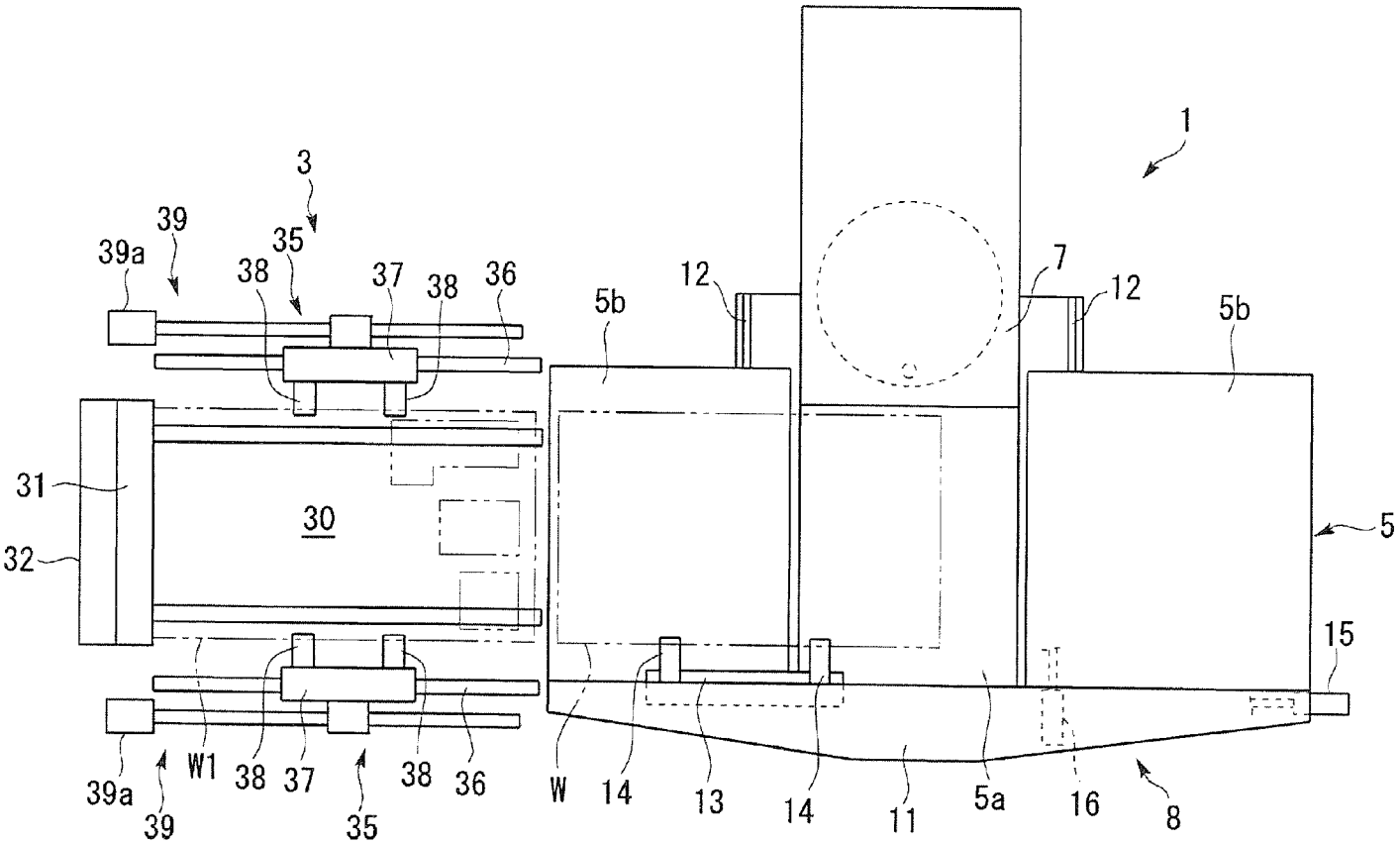
FIG. 8 is a plan view of a work sheet processing machine and a redundant work sheet stocker in a work sheet processing system according to a different embodiment.

The carry-in and carry-out means 35 according to the present embodiment is configured to use the work sheet holder 37 to grip only one side of the redundant work sheet W1 in a direction crossing the carry-in and carry-out direction to move the redundant work sheet W1 in the carry-in and carry-out direction. However, as shown in FIG. 8, the posture of the redundant work sheet 1 can be stabilized during the carry-in and carry-out operations by providing paired work sheet holders 37 on the opposite sides in the direction crossing the carry-in and carry-out direction so that the work sheet holders 37 grip the opposite sides of the redundant work sheet W1 to move the redundant sheet W1 in the carry-in and carry-out direction.

In the present embodiment, the redundant work sheet stocker 3 is located on the side of and adjacent to the work sheet processing machine 1. However, the redundant work sheet stocker 3 may be located away from the work sheet processing machine 1. Furthermore, the redundant work sheet stocker 3 according to the present embodiment carries out the redundant work sheet W1 carried out from the work sheet processing machine 1, to the original work sheet processing machine 1.

However, the work sheet processing machine 1 from which the redundant work sheet W1 is carried out may be different from the work sheet processing machine 1 into which that redundant work sheet W1 is carried.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the invention.

The invention claimed is:

1. A work sheet processing system, comprising:

a work sheet processing machine that performs a processing operation of cutting a product work sheet from a material work sheet;

a redundant work sheet stocker that stores a redundant work sheet, the redundant work sheet being a remaining part of said material work sheet from which said product work sheet has been cut by said work sheet processing machine; and a carry-in and carry-out means for carrying out said redundant work sheet from said work sheet processing machine to said redundant work sheet stocker, and for carrying said redundant work sheet from said redundant work sheet stocker to said work sheet processing machine, wherein said redundant work sheet stocker includes a plurality of work sheet supports disposed a different vertical positions, each of said plurality of work sheet supports being capable of supporting at least one redundant work sheet by direct contact, the plurality of work sheet supports being attached to an elevating and lowering member, wherein said carry-in and carry-out means comprises a work sheet holder that holds said redundant work sheet, wherein said work sheet holder moves while holding said redundant work sheet, wherein said redundant work sheet stocker is located on a side of and adjacent to said work sheet processing machine, wherein said redundant work sheet stocker can move said redundant work sheet in a predetermined carry-in and carry-out direction corresponding to a direction in which said work sheet processing machine and said redundant work sheet stocker are arranged, wherein said work sheet processing machine has a work sheet positioning mechanism that moves a work sheet to a processing head of said work sheet processing machine which performs said processing operation, and wherein said work sheet positioning mechanism can move said work sheet in said carry-in and carry-out direction.

2. The work sheet processing system of claim 1, wherein said work sheet holder of said carry-in and carry-out means is capable of holding the front of the work sheet by sandwiching the front edge of the work sheet from above and below, and wherein said work sheet positioning mechanism is capable of holding the front of the work sheet by sandwiching the front edge of the work sheet from above and below.

* * * * *